US011117178B2

(12) United States Patent
Nakamura et al.

(10) Patent No.: US 11,117,178 B2
(45) Date of Patent: Sep. 14, 2021

(54) FORMED MATERIAL MANUFACTURING METHOD AND FORMED MATERIAL

(71) Applicant: NISSHIN STEEL CO., LTD., Tokyo (JP)

(72) Inventors: Naofumi Nakamura, Sakai (JP); Yudai Yamamoto, Sakai (JP); Katsuhide Nishio, Sakai (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 744 days.

(21) Appl. No.: 15/317,244

(22) PCT Filed: Feb. 6, 2015

(86) PCT No.: PCT/JP2015/053373
§ 371 (c)(1),
(2) Date: Dec. 8, 2016

(87) PCT Pub. No.: WO2015/190125
PCT Pub. Date: Dec. 17, 2015

(65) Prior Publication Data

US 2017/0128998 A1 May 11, 2017

(30) Foreign Application Priority Data

Jun. 13, 2014 (JP) ..... JP2014-122298

(51) Int. Cl.
*B21D 22/28* (2006.01)
*B21D 22/21* (2006.01)
*B21D 22/30* (2006.01)

(52) U.S. Cl.
CPC ..... *B21D 22/28* (2013.01); *B21D 22/21* (2013.01); *B21D 22/30* (2013.01)

(58) Field of Classification Search
CPC ..... B21D 22/20–30
(Continued)

(56) References Cited

U.S. PATENT DOCUMENTS 3,682,122 A * 8/1972 Haddon ..... B21D 53/04 72/348
3,855,862 A * 12/1974 Moller ..... B21D 22/30 72/334
(Continued)

FOREIGN PATENT DOCUMENTS

EP 3015184 A1 5/2016
JP 2006-326671 A 12/2006
(Continued)

OTHER PUBLICATIONS

Japanese Communication dated Oct. 3, 2017, cited in 2014-122298, 4 pages.
(Continued)

*Primary Examiner* — Shelley M Self
*Assistant Examiner* — Jared O Brown
(74) *Attorney, Agent, or Firm* — Rothwell, Figg, Ernst & Manbeck, P.C.

(57) ABSTRACT

The invention provides a formed material manufacturing method by which unnecessary thickening of a flange can be avoided. The formed material manufacturing method allows a formed material to be manufactured by forming processes that include at least one drawing-out process, at least one drawing process performed after the drawing-out process, and at least one coining process performed after the drawing process. The width of the rear end side of a punch used in the drawing-out process is set to be wider than the width of the tip end side thereof. An ironing process is performed on a region corresponding to the flange of the base metal sheet by pushing the base metal sheet together with the punch into a pushing hole.

4 Claims, 7 Drawing Sheets

(58) Field of Classification Search
USPC ..... 72/347–349
See application file for complete search history.

(56) References Cited

U.S. PATENT DOCUMENTS 3,924,437 A * 12/1975 Hortig ..... B21D 22/286 72/349
3,945,231 A * 3/1976 Imazu ..... B21D 22/20 72/45
4,522,049 A * 6/1985 Clowes ..... B21D 22/30 220/608
4,562,719 A * 1/1986 Budrean ..... B21D 51/54 72/349
5,083,449 A * 1/1992 Kobayashi ..... B21D 51/26 72/349
5,179,854 A * 1/1993 Matsui ..... B21D 22/28 72/349
5,329,799 A * 7/1994 Ito ..... B21D 22/30 72/340
5,501,092 A * 3/1996 Miyazawa ..... B21D 22/04 72/328
5,722,282 A 3/1998 Mine et al.
5,778,722 A * 7/1998 Saiki ..... B21D 51/26 72/347
6,038,910 A 3/2000 McClung
6,386,013 B1 5/2002 Werth
6,701,603 B2 * 3/2004 Matsuura ..... H02K 1/17 29/421.1
2005/0115050 A1 * 6/2005 Ezaka ..... B21D 22/28 29/523
2008/0314112 A1 * 12/2008 Park ..... B21D 53/24 72/347
2015/0321242 A1 * 11/2015 Itou ..... B21D 22/02 29/894.325

FOREIGN PATENT DOCUMENTS

JP 5600821 B1 10/2014
KR 20080056775 A 6/2008
KR 10 2010 0093704 A 8/2010
KR 10-2010-0093704 A 8/2010
KR 20100093704 A * 8/2010 ..... B21D 22/20
WO WO-2013015604 A2 * 1/2013 ..... B21K 1/60
WO WO-2014192833 A1 * 12/2014 ..... B21D 22/02

OTHER PUBLICATIONS

Office Action issued for Philippines patent application No. 1/2016/502366 dated Aug. 3, 2018, 5 pages.
Indian Office Action issued for Indian patent application No. 201637042378 dated Jul. 31, 2019, with English translation, 7 pages.
International Preliminary Report issued for International Application No. PCT/JP2015/053373 dated Dec. 15, 2016, 12 pages.
Vietnamese Office Action issued for Vietnamese Patent Application No. 1-2016-04601 dated Oct. 10, 2020, 4 pages.
Communication issued for European Patent Application No. 15 805 752.1 dated May 25, 2021, 5 pages.

* cited by examiner

FORMED MATERIAL MANUFACTURING METHOD AND FORMED MATERIAL

Cross Reference to Related Application

This application is a 35 U.S.C. 371 National Phase Entry Application from PCT/JP2015/053373, filed Feb. 6, 2015, which claims the benefit of Japanese Patent Application No. 2014-122298 filed on Jun. 13, 2014, the disclosure of which is incorporated herein in its entirety by reference.

TECHNICAL FIELD

This invention relates to a formed material manufacturing method for manufacturing a formed material having a tubular body and a flange formed at an end of the body, and also relates to a formed material.

BACKGROUND ART

As disclosed, for example, in NPL 1, a formed material having a tubular body and a flange formed at an end of the body is manufactured by performing a drawing process. Since the body is formed by stretching a base metal sheet in the drawing process, the thickness of the body is less than that of the base sheet. Meanwhile, since the region of the metal sheet corresponding to the flange shrinks as a whole in response to the formation of the body, the flange thickness is larger than that of the base sheet.

The abovementioned formed material can be used as the motor case disclosed, for example, in PTL 1. Here, the body is expected to function as a shielding material that prevents magnetic leakage to the outside of the motor case. In some motor structures, the body is also expected to function as a back yoke of a stator. The performance of the body as the shield material or back yoke is improved as the thickness thereof increases. Therefore, when a formed material is manufactured by drawing, as described hereinabove, a base metal sheet with a thickness larger than the necessary thickness of the body is selected in consideration of the reduction in thickness caused by the drawing process. Meanwhile, the flange is most often used for mounting the motor case on the mounting object. Therefore, the flange is expected to have a certain strength.

Further, when a formed material is mounted on a mating member such as a chassis or panel, good adherence (air tightness) is sometimes needed between the forming material and the mating member. In such cases, the flange of the formed material is expected to have a uniform thickness and highly accurate flatness.

CITATION LIST

Patent Literature

[PTL 1]
Japanese Patent Application Publication No. 2013-51765

Non Patent Literature

[NPL 1]
"Basics of Plastic Forming", Masao Murakawa and three others, First Edition, SANGYO-TOSHO Publishing Co. Ltd., Jan. 16, 1990, pp. 104 to 107

SUMMARY OF INVENTION

Technical Problem

However, with the conventional formed material manufacturing method such as described hereinabove, since the formed material having a tubular body and a flange formed at the end of the body is manufactured by the drawing process, the flange thickness is larger than that of the base sheet. For this reason, the flange sometimes becomes unnecessarily thick and has a thickness in excess of that needed to obtain the performance expected from the flange. It means that the formed material becomes unnecessarily heavy, which cannot be ignored in applications in which weight reduction is required, such as motor cases.

Further, thickness reduction of the flange by pressing can be also considered for obtaining a uniform flange thickness or realizing a highly accurate flange flatness. However, since the flange thickness increases gradually towards the outer circumference thereof, the thickness is preferentially reduced close to the thick outer circumference, and a uniform thickness is difficult to obtain for the entire flange. In addition, where such flange is made thinner by pressing, a high-power press is needed. Therefore, a restriction is placed on the press that can be used.

The present invention has been created to resolve the abovementioned problems, and it is an objective of the present invention to provide a formed material manufacturing method by which unnecessary thickening of the flange can be avoided, a formed material can be reduced in weight, a base metal sheet can be reduced in size, uniformity of flange thickness can be improved, and a highly accurate flatness can be obtained, and also to provide a formed material.

Solution to Problem

The formed material manufacturing method in accordance with the present invention is a formed material manufacturing method of manufacturing a formed material having a tubular body and a flange, which is formed at an end of the body, by performing at least three forming processes on a base metal sheet, wherein the at least three forming processes include at least one drawing-out process, at least one drawing process performed after the drawing-out process, and at least one coining process performed after the drawing process, the drawing-out process is performed using a mold that includes a punch and a die having a pushing hole, a width of a rear end side of the punch is set to be wider than a width of a tip end side thereof so that a clearance between the die and the punch, when the punch is pushed into the pushing hole in the die, is narrower on the rear end side than on the tip end side, an ironing process is performed on a region corresponding to the flange of the base metal sheet by pushing the base metal sheet together with the punch into the pushing hole in the drawing-out process, and in the coining process, the flange formed in the drawing process is inserted between a pushing mold and a receiving mold and compressed.

Further, a formed material according to the present invention has a tubular body and a flange formed at an end of the body and is manufactured by performing at least three forming processes on a base metal sheet, wherein the at least three forming processes include at least one drawing-out process, at least one drawing process performed after the drawing-out process, and at least one coining process performed after the drawing process, an ironing process is performed on a region corresponding to the flange of the base metal sheet in the drawing-out process, and in the coining process, the flange is compressed between a pushing mold and a receiving mold, thereby making the thickness of the flange less than that of a circumferential wall of the body.

Furthermore, a formed material according to the present invention has a tubular body and a flange formed at an end of the body and is manufactured by performing at least three forming processes on a base metal sheet, wherein the at least three forming processes include at least one drawing-out process, at least one drawing process performed after the drawing-out process, and at least one coining process performed after the drawing process, an ironing process is performed on a region corresponding to the flange of the base metal sheet in the drawing-out process, and in the coining process, the flange is compressed between a pushing mold and a receiving mold, thereby making the thickness of the flange less than that of the base metal sheet.

Advantageous Effects of Invention

With the formed material manufacturing method and the formed material according to the present invention, the ironing process is performed on the region corresponding to the flange of the base metal sheet by pushing the base metal sheet together with the punch into the pushing hole in the drawing-out process, and the coining process is performed by inserting the flange between the pushing mold and receiving mold and compressing. Therefore, an unnecessary increase in the thickness of the flange can be avoided, the formed material can be reduced in weight, the uniformity of the thickness of the flange can be improved, and a highly accurate flatness can be obtained. Further, since the thickness of the flange is reduced by the ironing process, the press power necessary for the coining process can be greatly reduced, and the processing can be expected to be performed with a press machine that is lower in power than those in the conventional processing. This configuration is particularly useful in applications in which weight reduction is required, such as motor cases.

DESCRIPTION OF EMBODIMENTS

Embodiments of the present invention will be described below with reference to the drawings.

Embodiment 1

Figure 1:
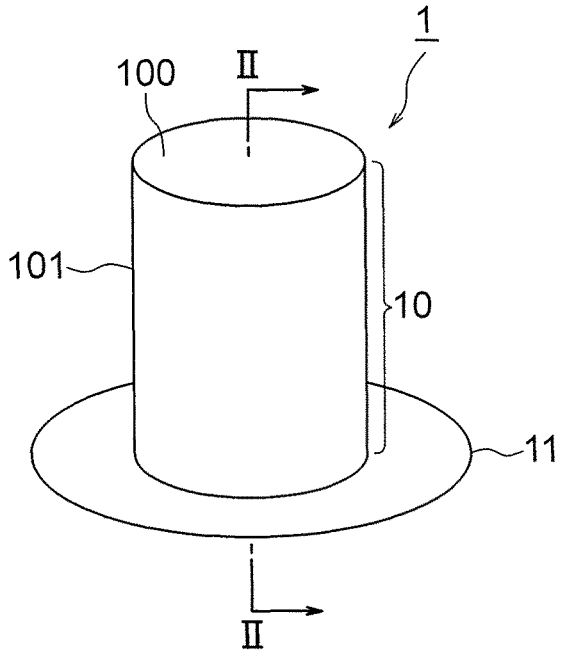
FIG. 1 is a perspective view showing a formed material manufactured by a formed material manufacturing method according to Embodiment 1 of the present invention.

FIG. 1 is a perspective view showing a formed material 1 manufactured by a formed material manufacturing method according to Embodiment 1 of the present invention. As shown in FIG. 1, the formed material 1 manufactured by the formed material manufacturing method according to the present embodiment includes a body 10 and a flange 11. The body 10 is a tubular part having a top wall 100 and a circumferential wall 101 that extends from an outer edge of the top wall 100. Depending on the orientation in which the formed material 1 is to be used, the top wall 100 may be referred to using another term, such as a bottom wall. In FIG. 1, the body 10 is shown to have a perfectly circular sectional shape, but the body 10 may have another shape, for example, such as an elliptical sectional shape or angular tubular shape. The top wall 100 may be subjected to further processing. For example, a protrusion projecting from the top wall 100 can be formed. The flange 11 is a sheet portion formed on an end (an end of the circumferential wall 101) of the body 10.

Figure 2:
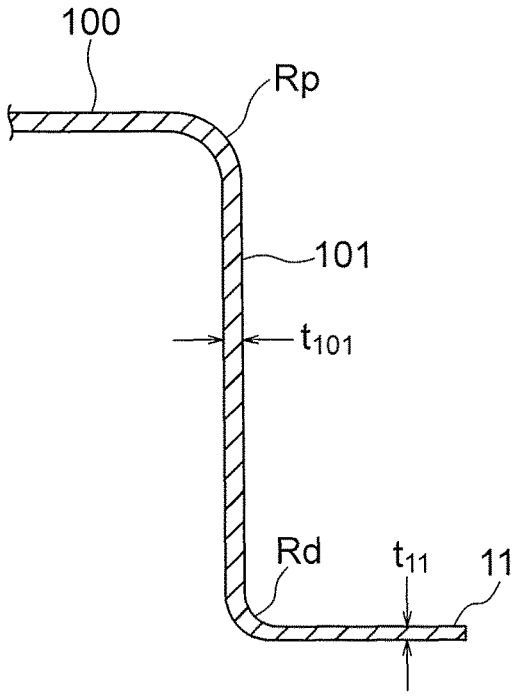
FIG. 2 is a sectional view taken along a II-II line in FIG. 1.

FIG. 2 is a sectional view taken along a line II-II in FIG. 1. As shown in FIG. 2, a sheet thickness $t_{11}$ of the flange 11 is less than a sheet thickness $t_{101}$ of the circumferential wall 101 of the body 10. The reason for this, as will be described in detail hereinbelow, is that the ironing process is performed on a region of a base metal sheet 2 (see FIG. 3) corresponding to the flange 11. The sheet thickness $t_{11}$ of the flange 11, as referred to herein, means an average value of the sheet thickness of the flange 11 from a lower end of a lower side shoulder portion Rd between the circumferential wall 101 and the flange 11 and an outer end of the flange 11. Similarly, the sheet thickness $t_{101}$ of the circumferential wall 101 means an average value of the sheet thickness of the circumferential wall 101 from an upper end of the lower side shoulder portion Rd to a lower end of an upper side shoulder portion Rp.

Figure 3:
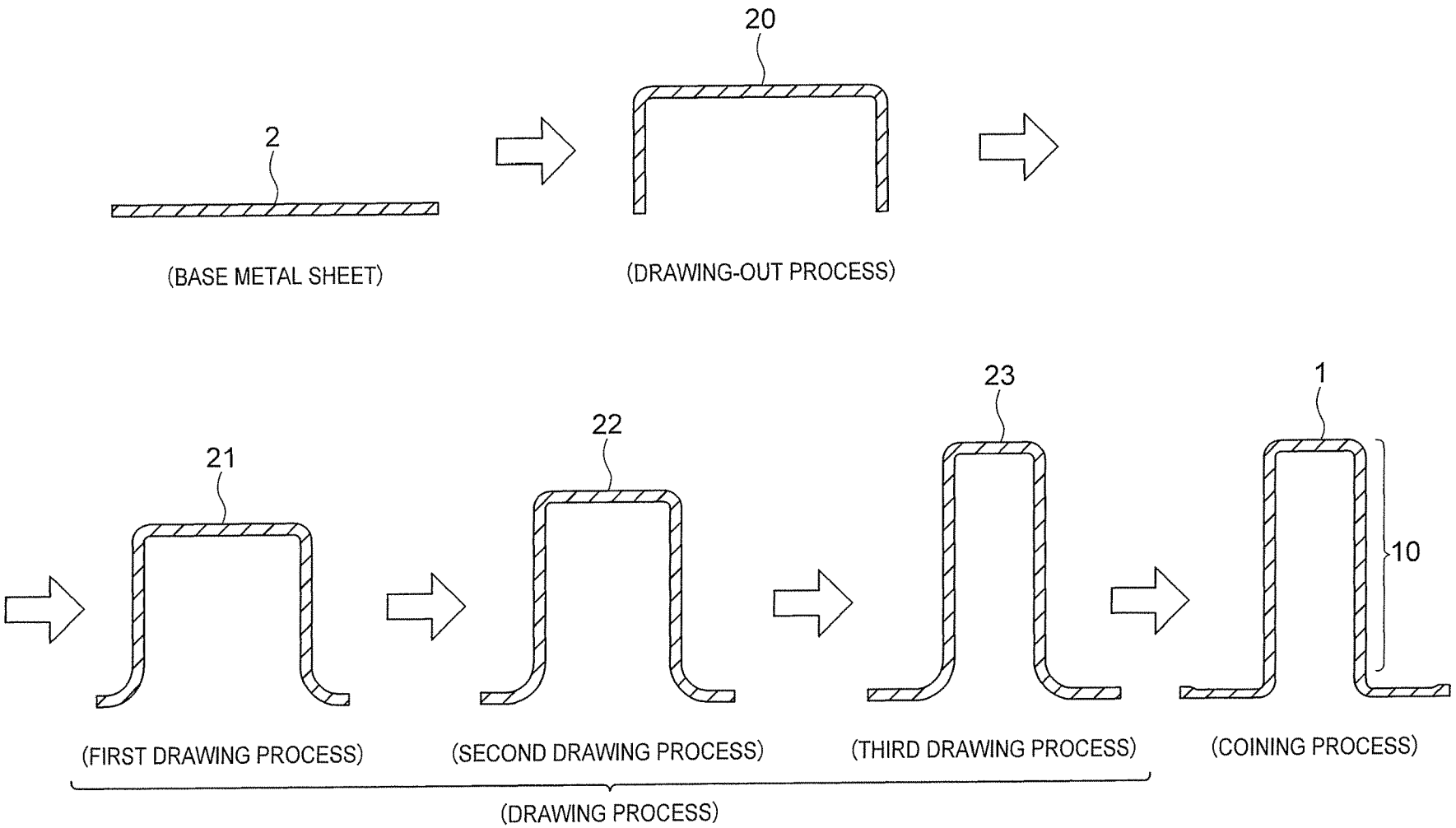
FIG. 3 is an explanatory drawing illustrating the formed material manufacturing method for manufacturing the formed material depicted in FIG. 1.

FIG. 3 is an explanatory drawing illustrating the formed material manufacturing method for manufacturing the formed material 1 depicted in FIG. 1. In the formed material manufacturing method according to the present invention, the formed material 1 is manufactured by performing at least three forming processes on the flat base metal sheet 2. The at least three forming processes include at least one drawing-out process, at least one drawing process performed after the drawing-out process, and at least one coining process performed after the drawing process. In the formed material manufacturing method according to this embodiment, the formed material 1 is manufactured by one drawing-out process, three drawing processes (first to third drawing processes), and one coining process. Various types of metal sheets, such as a cold-rolled steel sheet, a stainless steel sheet, and a plated steel sheet, can be used as the base metal sheet 2.

Figure 4:
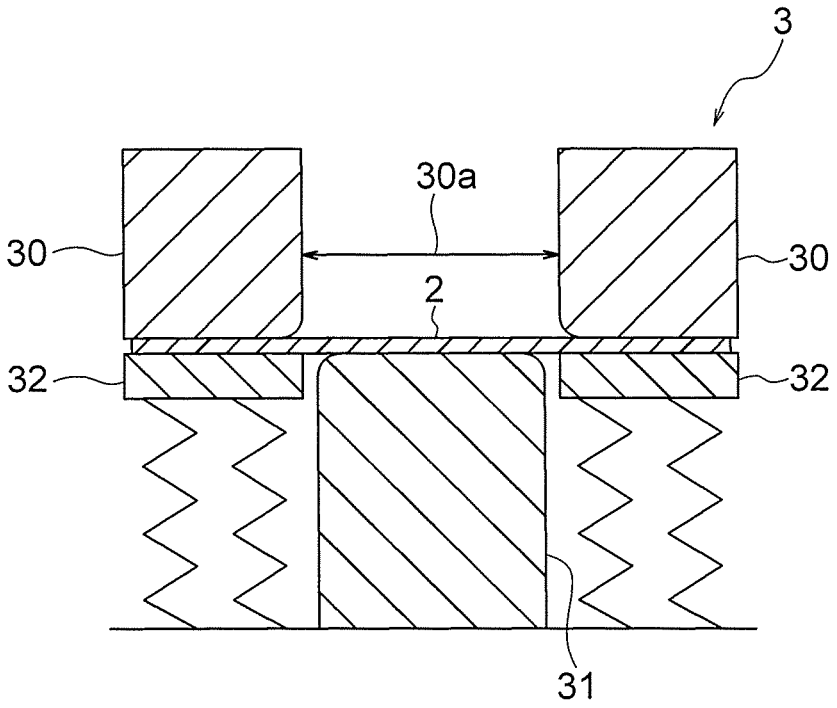
FIG. 4 is an explanatory drawing illustrating a mold used in a drawing-out process depicted in FIG. 3.
Figure 5:
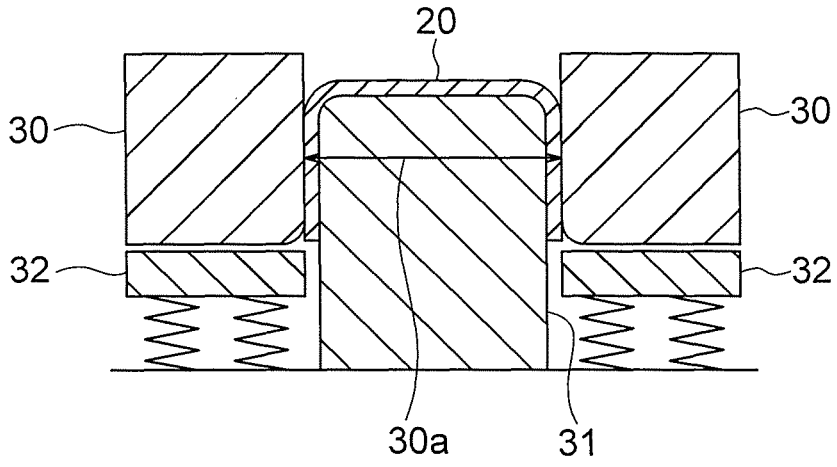
FIG. 5 is an explanatory drawing illustrating the drawing-out process performed with the mold depicted in FIG. 4.

FIG. 4 is an explanatory drawing illustrating a mold 3 used in the drawing-out process depicted in FIG. 3, and FIG. 5 is an explanatory drawing illustrating the drawing-out process performed with the mold 3 depicted in FIG. 4. As shown in FIG. 4, the mold 3 used in the drawing-out process includes a die 30, a punch 31, and a cushion pad 32. A pushing hole 30*a* into which the base metal sheet 2 is pushed together with the punch 31 is provided in the die 30. The cushion pad 32 is disposed at an outer peripheral position of the punch 31 so as to face an outer end surface of the die 30. As shown in FIG. 5, in the drawing-out process, an outer edge portion of the base metal sheet 2 is not completely constrained by the die 30 and the cushion pad 32, and the outer edge portion of the base metal sheet 2 is drawn out until it escapes from the constraint applied thereto by the die 30 and the cushion pad 32. The entire base metal sheet 2 may be pushed together with the punch 31 into the pushing hole 30*a* and drawn out.

Figure 6:
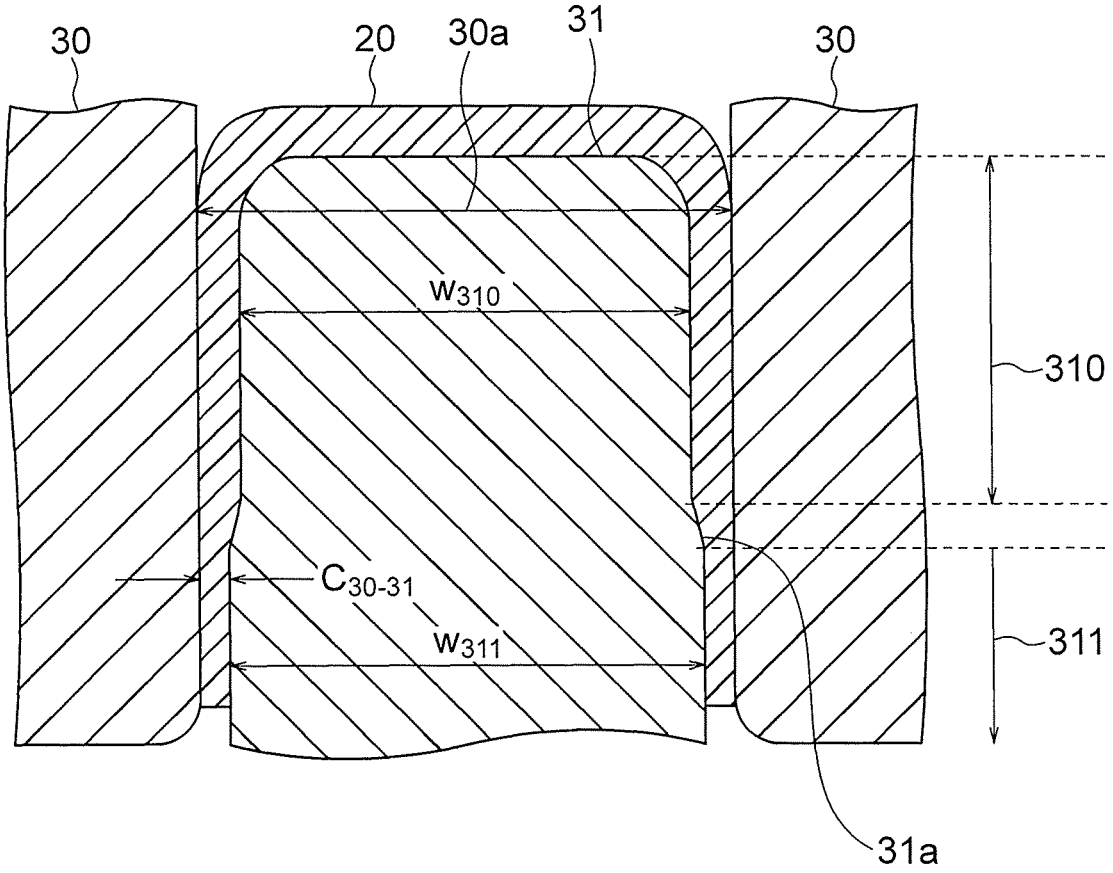
FIG. 6 is an explanatory drawing illustrating in greater detail the punch depicted in FIG. 4.

FIG. 6 is an explanatory drawing illustrating in greater detail the punch 31 depicted in FIG. 4. As shown in FIG. 6, a width $w_{311}$ of a rear end side 311 of the punch 31 used in the drawing-out process is greater than a width $w_{310}$ of a tip end side 310 of the punch 31. Meanwhile a width of the pushing hole 30*a* is set to be substantially uniform along an insertion direction in which the punch 31 is inserted into the pushing hole 30*a*. In other words, an inner wall of the die 30 extends substantially parallel to the insertion direction of the punch 31.

Thus, as shown in FIG. 6, a clearance $c_{30\text{-}31}$ between the die 30 and the punch 31 in a state in which the punch 31 is pushed into the pushing hole 30*a* is narrower on the rear end side 311 of the punch 31 than on the tip end side 310 of the punch 31. The clearance $c_{30\text{-}31}$ on the rear end side 311 of the punch 31 is set to be narrower than the sheet thickness of the base metal sheet 2 before the drawing-out process is performed. Therefore, as a result of pushing the base metal sheet 2 together with the punch 31 into the pushing hole 30*a* in the drawing-out process, the ironing process is performed on the outer edge portion of the base metal sheet 2, that is, on a region of the base metal sheet 2 corresponding to the flange 11. The ironing process reduces the sheet thickness of the region corresponding to the flange 11 (makes the region thinner).

A width variation portion 31*a* configured of an inclined surface on which a width of the punch 31 varies continuously is provided between the tip end side 310 and the rear end side 311 of the punch 31. The width variation portion 31*a* is disposed such as to be in contact with a region of the base metal sheet 2 corresponding to the lower side shoulder portion Rd (see FIG. 2) between the width variation portion 31*a* and the inner wall of the die 30 when the base metal sheet 2 is pushed together with the punch 31 into the pushing hole 30*a* in the drawing-out process.

Figure 7:
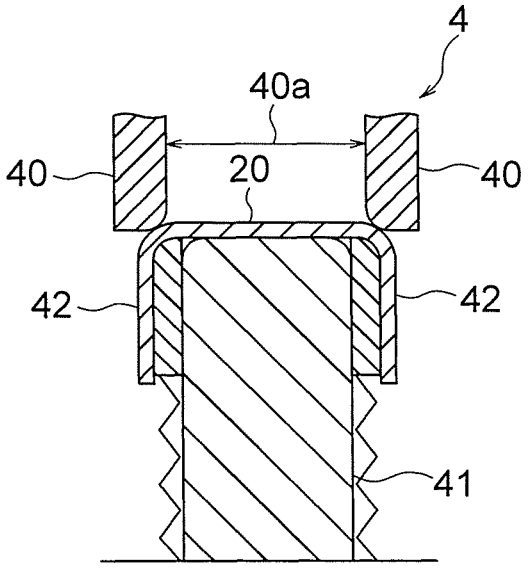
FIG. 7 is an explanatory drawing illustrating the mold used in the first drawing process illustrated by FIG. 3.
Figure 8:
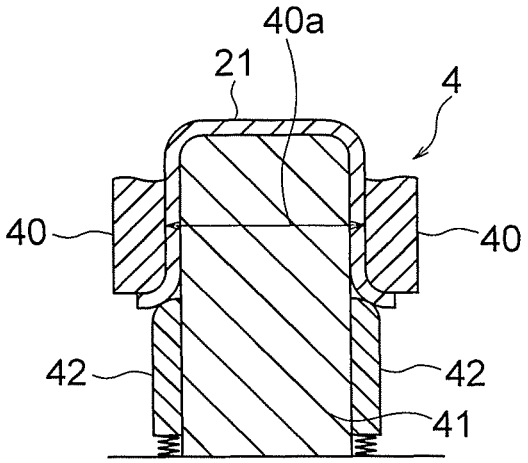
FIG. 8 is an explanatory drawing illustrating the first drawing process performed with the mold depicted in FIG. 7.

FIG. 7 is an explanatory drawing illustrating the mold 4 used in the first drawing process illustrated by FIG. 3. FIG. 8 is an explanatory drawing illustrating the first drawing process performed with the mold 4 depicted in FIG. 7. As shown in FIG. 7, the mold 4 used in the first drawing process includes a die 40, a punch 41, and a drawing sleeve 42. A pushing hole 40*a* into which a first intermediate body 20, which is formed in the above-described drawing-out process, is pushed together with the punch 41 is provided in the die 40. The drawing sleeve 42 is disposed at an outer peripheral position of the punch 41 so as to face an outer end surface of the die 40. As shown in FIG. 8, in the first drawing process, the drawing process is performed on a region of the first intermediate body 20 corresponding to the body 10, and the flange 11 is formed by constraining an outer edge portion of the first intermediate body 20 by the die 40 and the drawing sleeve 42. The purpose of the sleeve 42 is to prevent the occurrence of wrinkles during the drawing, and the sleeve 42 may be omitted when no wrinkle occurs.

The second and third drawing processes depicted in FIG. 3 can be implemented using a conventional mold (such an implementation is not illustrated by the drawings). In the second drawing process, the drawing process is further performed on a region of a second intermediate body 21 (see FIG. 3) formed in the first drawing process, this region corresponding to the body 10. The third drawing process corresponds to a re-striking process, in which the ironing process is performed on a region of a third intermediate body 22 (see FIG. 3) formed in the second drawing process, this region corresponding to the body 10.

In the first to third drawing processes, shrinkage occurs in the region corresponding to the flange 11, and an increase in the thickness occurs in this region. However, by reducing sufficiently the sheet thickness of the region corresponding to the flange 11 in the drawing-out process, it is possible to make the sheet thickness $t_{11}$ of the flange 11 less than the sheet thickness $t_{101}$ of the circumferential wall 101 of the body 10 in the final formed material 1. An amount by which the sheet thickness of the region corresponding to the flange 11 is reduced in the drawing-out process can be adjusted, as appropriate, by changing the clearance $c_{30\text{-}31}$ on the rear end side 311 of the punch 31 of the mold 3 used in the drawing-out process.

Figure 9:
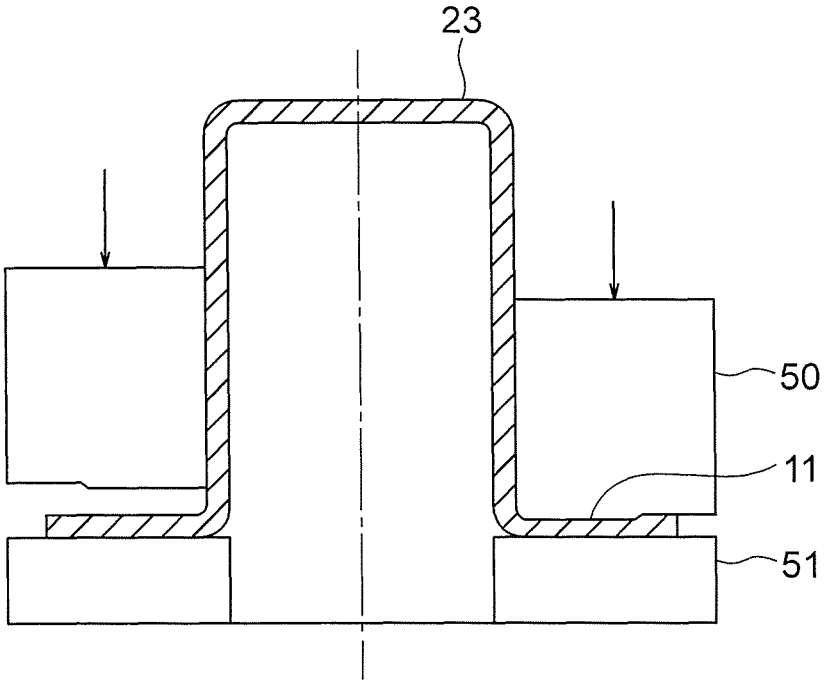
FIG. 9 is an explanatory drawing illustrating a mold used in the coining process illustrated by FIG. 3.

FIG. 9 is an explanatory drawing illustrating a mold used in the coining process of the flange illustrated by FIG. 3. FIG. 9 illustrates the states before and after the coining process, those states being separated by the dot-dash line in the center. As depicted in FIG. 9, the mold includes a pushing mold 50 (upper mold) for coining and a receiving mold 51 (lower mold) that receives the pushing mold 50. A step corresponding to the flange shape of the final product is provided at the pushing mold 50. The flange 11 of the fourth intermediate body 23 formed in the drawing process is inserted between the pushing mold 50 and the receiving mold 51 and receives a pushing pressure, whereby the flange region necessary for the product is compressed and reduced in thickness. A portion of the flange 11 which is not compressed in the coining process is trimmed after the coining process.

The flange 11 is a part formed from the outer edge portion of the base metal sheet 2 in the drawing process. In the intermediate bodies 20 to 22 manufactured by the formed material manufacturing method according to the present invention, the region corresponding to the flange 11 when the drawing-out process is performed on the base metal sheet 2 is reduced in thickness by the ironing process. Therefore, the flange 11 of the formed body 1 which is manufactured by the formed body manufacturing method according to the present invention is less in thickness than the flange of the usual formed body. For this reason, the coining process can be performed even by using a press machine which is less powerful than that in the conventional methods. The coining process, as referred to herein, is a compression process in which a pressure from about several tons to, in some cases, a high pressure in excess of 100 tons is applied to a workpiece. The workpiece is generally also patterned by the coining process, but the coining process of the present embodiment may be performed without patterning the flange 11.

Next, examples will be described. The inventors of the present application performed the drawing-out process under the following processing conditions by using, as the base metal sheet 2, a round sheet having a thickness of 1.8 mm and a diameter of 116 mm and formed by implementing Zn—Al—Mg plating on a common cold-rolled steel sheet. Here, the Zn—Al—Mg alloy plating was implemented on both surfaces of the steel sheet, and a plating coverage was 90 g/m$^2$ on each surface.

Ironing ratio of region corresponding to flange 11: −20% to 60%

Curvature radius of mold 3: 6 mm

Diameter of pushing hole 30*a*: 70 mm

Diameter of tip end side 310 of punch 31: 65.7 mm

Diameter of rear end side 311 of punch 31: 65.7 mm to 68.6 mm

Shape of width variation portion 31*a*: inclined surface

Position of width variation portion 31*a*: region corresponding to lower side shoulder portion Rd Coining process: no, yes (500 kN)

Press oil: TN-20

<Evaluation of Ironing Ratio>

When the ironing ratio was 30% or less (when the diameter of the rear end side 311 of the punch 31 was 67.5 mm or less), the processing could be performed without problems. Meanwhile, when the ironing ratio was greater than 30% and equal to or less than 50% (when the diameter of the rear end side 311 of the punch 31 was greater than 67.5 mm and equal to or less than 68.2 mm), a slight scratching mark was found at a portion that slides against the die 30. Further, when the ironing ratio exceeded 50% (when the diameter of the rear end side 311 of the punch 31 was greater than 67.9 mm), seizure and cracking occurred against the inner wall of the die 30. It is, therefore, clear that the ironing ratio of the region corresponding to the flange 11 in the drawing-out process is preferably equal to or less than 50%, and more preferably equal to or less than 30%. The ironing ratio is defined as {[(pre-ironing sheet thickness)−(post-ironing sheet thickness)]/(pre-ironing sheet thickness)}×100. Here, a value of the sheet thickness of the base metal sheet can be used as the pre-ironing sheet thickness.

Figure 10:
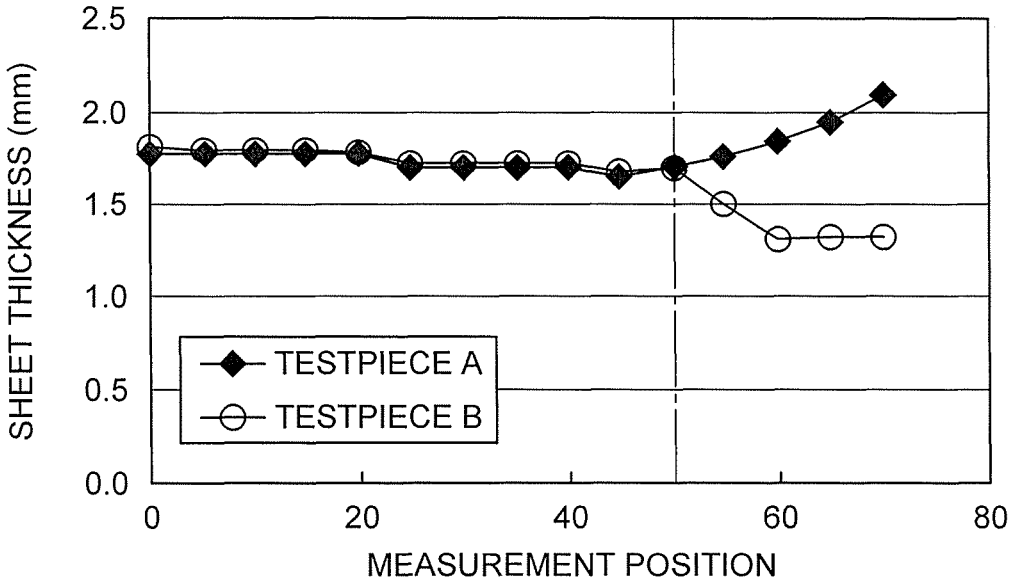
FIG. 10 is a graph showing the difference in sheet thickness of a first intermediate body occurring when an ironing ratio is changed.
Figure 11:
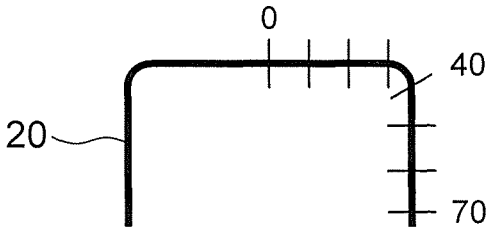
FIG. 11 is an explanatory drawing illustrating the sheet thickness measurement positions depicted in FIG. 10.

FIG. 10 is a graph showing the difference in sheet thickness of the first intermediate body 20 occurring when an ironing ratio is changed. Further, FIG. 11 is an explanatory drawing illustrating the sheet thickness measurement positions depicted in FIG. 10. FIG. 10 shows the sheet thickness of the first intermediate body 20 when the drawing-out process was performed at an ironing ratio of −20% (testpiece A; a comparative example) and the sheet thickness of the first intermediate body 20 when the drawing-out process was performed at an ironing ratio of 30% (testpiece B). As shown in FIG. 10, when the drawing-out process was performed at an ironing ratio of 30% (testpiece B), the sheet thickness in the region corresponding to the flange 11 (measurement positions 50 to 70) was less than the sheet thickness (1.8 mm) of the base metal sheet 2. Meanwhile, when the drawing-out process was performed at an ironing ratio of −20% (testpiece A), the sheet thickness in the region corresponding to the flange 11 (measurement positions 50 to 70) was larger than the sheet thickness (1.8 mm) of the base metal sheet 2.

Figure 12:
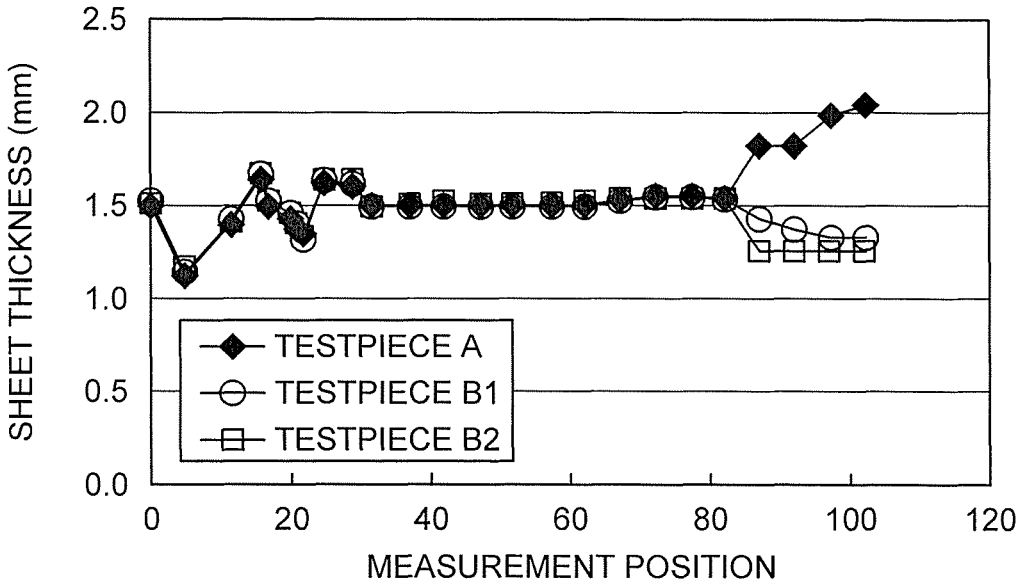
FIG. 12 is a graph showing the sheet thickness of the formed materials manufactured from respective first intermediate bodies depicted in FIG. 10.
Figure 13:
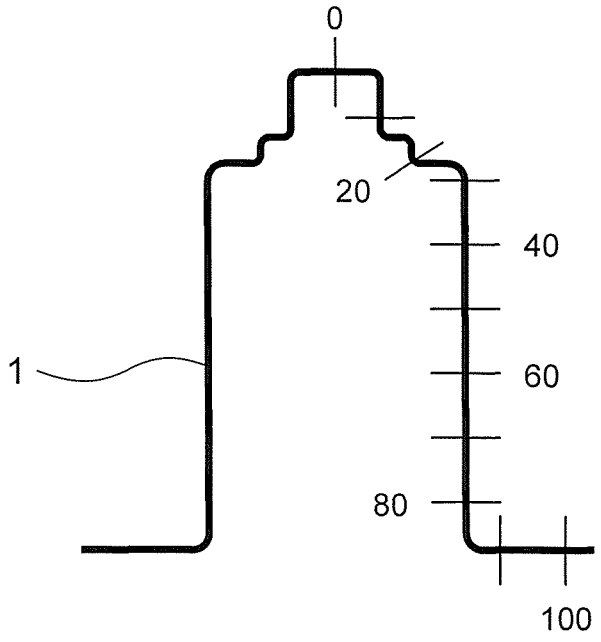
FIG. 13 is an explanatory drawing illustrating the sheet thickness measurement positions depicted in FIG. 12.

Further, FIG. 12 is a graph showing the sheet thickness of the formed materials 1 manufactured from respective first intermediate bodies 20 (testpiece A and testpiece B) depicted in FIG. 10. FIG. 13 is an explanatory drawing illustrating the sheet thickness measurement positions depicted in FIG. 12.

In the testpiece A (comparative example) depicted in FIG. 12, the drawing process was performed on the first intermediate body 20 (testpiece A depicted in FIG. 10) on which the drawing-out process was performed without ironing, and the coining process was not performed on the flange 11.

In the testpiece B1 (comparative example) depicted in FIG. 12, the drawing process was performed on the first intermediate body 20 (testpiece B depicted in FIG. 10) on which the drawing-out process including ironing was performed, and the coining process was not performed on the flange 11.

In the testpiece B2 (example of the invention) depicted in FIG. 12, the drawing process was performed on the first intermediate body 20 (testpiece B depicted in FIG. 10) on which the drawing-out process including ironing was performed, and the coining process was performed on the flange 11.

As depicted in FIG. 12, differences in the sheet thickness at the stage of the first intermediate body 20 appear, without changes, also in the formed material 1. In other words, in the testpiece A (comparative example), the sheet thickness of the flange 11 in the final formed material 1 is larger than the sheet thickness of the body in the formed material.

In the testpiece B1 (comparative example), the thickness of the flange 11 in the final formed material 1 is generally reduced. However, the sheet thickness of the flange 11 is not uniform.

Meanwhile, in the testpiece B2 (example of the invention), it is clear that the sheet thickness of the flange 11 is uniform.

Further, when the formed material 1 (testpiece B1 or testpiece B2) subjected to the drawing-out process that included ironing and the formed material 1 (testpiece A) which was not subjected to the drawing-out process that included ironing had the same dimensions, the weight of the testpiece B1 or B2 was about 10% less than the weight of the testpiece A.

When a drawing-out process including ironing is performed, the region of the base metal sheet 2 corresponding to the flange 11 is stretched. In order to form the formed material 1 subjected to the drawing-out process including ironing (example of the invention) and the formed material 1 not subjected to the drawing-out process including ironing (comparative example) at identical dimensions, either a smaller base metal sheet 2 may be used while taking into consideration, in advance, an amount by which the region corresponding to the flange 11 is stretched, or an unnecessary portion of the flange 11 may be trimmed.

In such formed material manufacturing method and the formed material 1 manufactured thereby, the ironing process is performed on the region of the base metal sheet 2 corresponding to the flange 11 in the drawing-out process by pushing the base metal sheet 2 together with the punch 31 into the pushing hole 30*a*, and therefore an unnecessary increase in the thickness of the flange 11 can be avoided and the formed material 1 can be reduced in weight. Further, by performing the coining process on the flange 11 after the drawing process, it is possible obtain the flange with highly accurate thin sheet thickness and flatness. This configuration is particularly useful in applications in which weight reduction of the formed material, size reduction of the base metal sheet, and a highly accurate thin flange are required, such as motor cases.

Further, the ironing ratio of the ironing process performed during the drawing-out process is equal to or less than 50%, and therefore the occurrence of seizure and cracking can be avoided.

In the embodiment described above, the drawing-out process is performed only once, but two or more drawing-out processes may be performed before the drawing process.

By performing a plurality of drawing-out processes, the thickness of the flange 11 can be reduced more reliably. A plurality of drawing-out processes is particularly effective when the base metal sheet 2 is thick. Even when a plurality of drawing-out processes is performed, the ironing ratio of each process is still preferably set to be equal to or less than 50% to avoid seizure and the like. Further, by setting the ironing ratio to be equal to or less than 30%, scratch marks can also be avoided.

Further, in the embodiment described above, the drawing process is performed three times, but the number of the drawing processes may be changed, as appropriate, according to the size and required dimensional accuracy of the formed material 1.

The invention claimed is:

1. A method of manufacturing a formed material having a tubular body and a flange, which is formed at an end of the body, the method comprising performing at least three forming processes on a base metal sheet, wherein the at least three forming processes include at least one drawing-out process, at least one drawing process, and at least one coining process, wherein each of the drawing processes are performed after all of the drawing-out processes are completed, and each of the coining processes are performed after all of the at least one drawing processes are completed, wherein each of the at least one drawing-out process comprises using a mold that includes a punch and a die having a pushing hole and placing the base metal sheet that is substantially flat between the punch and the die, wherein a width of a rear end side of the punch is set to be wider than a width of a tip end side thereof so that a clearance between the die and the punch, when the punch is pushed into the pushing hole in the die, is narrower on the rear end side than on the tip end side, wherein each of the at least one drawing-out process comprises performing an ironing process on a region of the base metal sheet corresponding to the flange of the formed material by pushing the base metal sheet together with the punch into the pushing hole, wherein the tubular body is formed during a first drawing-out process of the at least one drawing-out processes, wherein the flange is formed during a first drawing process of the at least one drawing processes, and wherein one or more of the at least one coining process comprises inserting and compressing the flange formed in the at least one drawing process between a pushing mold and a receiving mold so that the flange receives a pushing pressure when the pushing mold is pushed toward the receiving mold, whereby a flange region is compressed and reduced in thickness, and wherein one or more of the at least one coining processes forms a flat portion extending over an entire circumference of the flange on both a top surface and bottom surface of the flange.

2. The method of manufacturing a formed material according to claim 1, wherein an ironing ratio of the ironing process is 50% or less.

3. The method of manufacturing a formed material according to claim 1, wherein each of the at least one coining process is performed on a part of the base metal sheet where the ironing process has been performed in each of the at least one drawing-out process.

4. The method of manufacturing a formed material according to claim 1, wherein a thickness of the flange of the formed material is less than a thickness of the base metal sheet.

* * * * *